United States Patent [19]

Standbridge et al.

[11] 3,943,844

[45] Mar. 16, 1976

[54] BALING MACHINE

[75] Inventors: Wilbur R. Standbridge, Ann Arbor; Larry D. Butler, Pinckney; William H. Sivy, Ann Arbor, all of Mich.

[73] Assignee: Ann Arbor Baler Company, Ann Arbor, Mich.

[22] Filed: Dec. 12, 1974

[21] Appl. No.: 531,850

[52] U.S. Cl. ..... 100/53; 74/424.8 R; 100/290; 200/61.18

[51] Int. Cl.[2] ..... B30B 1/18; B30B 15/28

[58] Field of Search ..... 100/290, 53, 229 A; 74/424.8 R, 89.15; 200/61.18; 187/25

[56] References Cited

UNITED STATES PATENTS

| | | | |
|---|---|---|---|
| 1,646,355 | 10/1927 | Hill | 100/290 X |
| 2,525,327 | 10/1950 | Weber | 200/61.18 |
| 2,802,549 | 8/1957 | Santos et al. | 74/424.8 R |
| 2,987,939 | 6/1961 | Waninger | 74/424.8 R |
| 3,237,921 | 3/1966 | Jay | 74/424.8 R |
| 3,353,478 | 11/1967 | Hopkins | 100/290 X |
| 3,613,561 | 10/1971 | Difley | 100/290 X |
| 3,827,350 | 8/1974 | Gilman | 100/53 X |

*Primary Examiner*—Billy J. Wilhite
*Attorney, Agent, or Firm*—Olsen and Stephenson

[57] ABSTRACT

Apparatus for compacting discarded wastepaper, cardboard boxes and the like into bale form comprising a container having a floor, a platen movable downwardly toward the floor for compacting the material, and a drive means for pulling the platen downwardly. The drive means includes a pair of upright screws drivingly connected to opposite ends of the platen, a pair of pulleys engaged with the lower ends of the screws, and a pair of drive belts which connect the pulleys to a motor, which is positioned on the back wall of the container at substantially equal distances from each screw. Turning of the pulleys by the motor additionally rotates the screws thereby driving the platen up or down. A pair of circuit interrupting switches are electrically associated with the motor and engage the drive belts. The switches are operable to shut off the motor in response to belt breakage.

1 Claim, 2 Drawing Figures

BALING MACHINE

Background of the Invention

Baling machines which compact material into bale form have been in use for many years. Many have utilized motor-driven assemblies in which the motor has been located on the side or top of the baler. Since the motor occupies a considerable amount of space, this adds greatly to the width or height of the machine. Also, some previous balers have employed belts in the process of driving the compressing platen downwardly. These belts are, however, subject to breakage. Should a belt break during the baling process, serious damage could be done to the machine before the motor could be turned off. It is an object of the present invention, therefore, to provide a baling maching which uses a minimum amount of space. Another object of the invention is to provide a means for immediately shutting off the motor of belt driven machines in response to belt breakage.

Summary of the Invention

The compactor apparatus of this invention provides, in a preferred form, a motor assembly mounted on the back of the machine, thus decreasing the width and height of the machine. This does not greatly increase the front-to-back space requirements for the machine, as space must be provided in back of the machine for maintenance in any case. The present invention also provides circuit interrupting switches engaged with the drive belts which detect belt breakage and immediately shut off the motor in case either belt breaks.

The compactor apparatus comprises a container having a floor, a housing on the container, a platen movably mounted in the container, and a drive system for moving the platen downwardly toward the floor to compact material in the container. The necessary downward pulling forces are provided by a pair of upright screws located at opposite ends of the platen, a pair of nuts mounted on the screws and secured to the platen, and a drive mechanism for rotating the screws to thereby drive the platen downwardly. The drive mechanism includes a pair of pulleys engaged with the lower ends of the screws, a motor mounted on the back wall of the housing and having a drive shaft provided with a pair of pulleys, and a pair of belts each of which encircles a screw pulley and a motor pulley, so that turning of the pulleys by the motor serves to rotate the screws and drive the platen downwardly. A pair of circuit interrupting switches are electrically connected to the motor and have movable actuating arms which engage the belts so that breakage of a belt allows the arm to move to a position in which the circuit is interrupted and the motor is immediately shut off.

Figure 2:
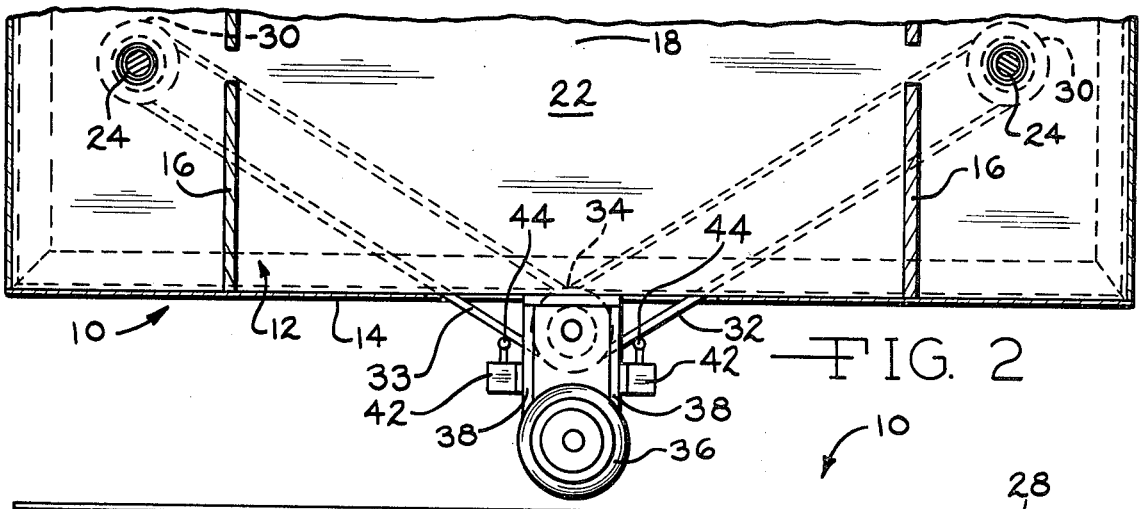
Figure 1:
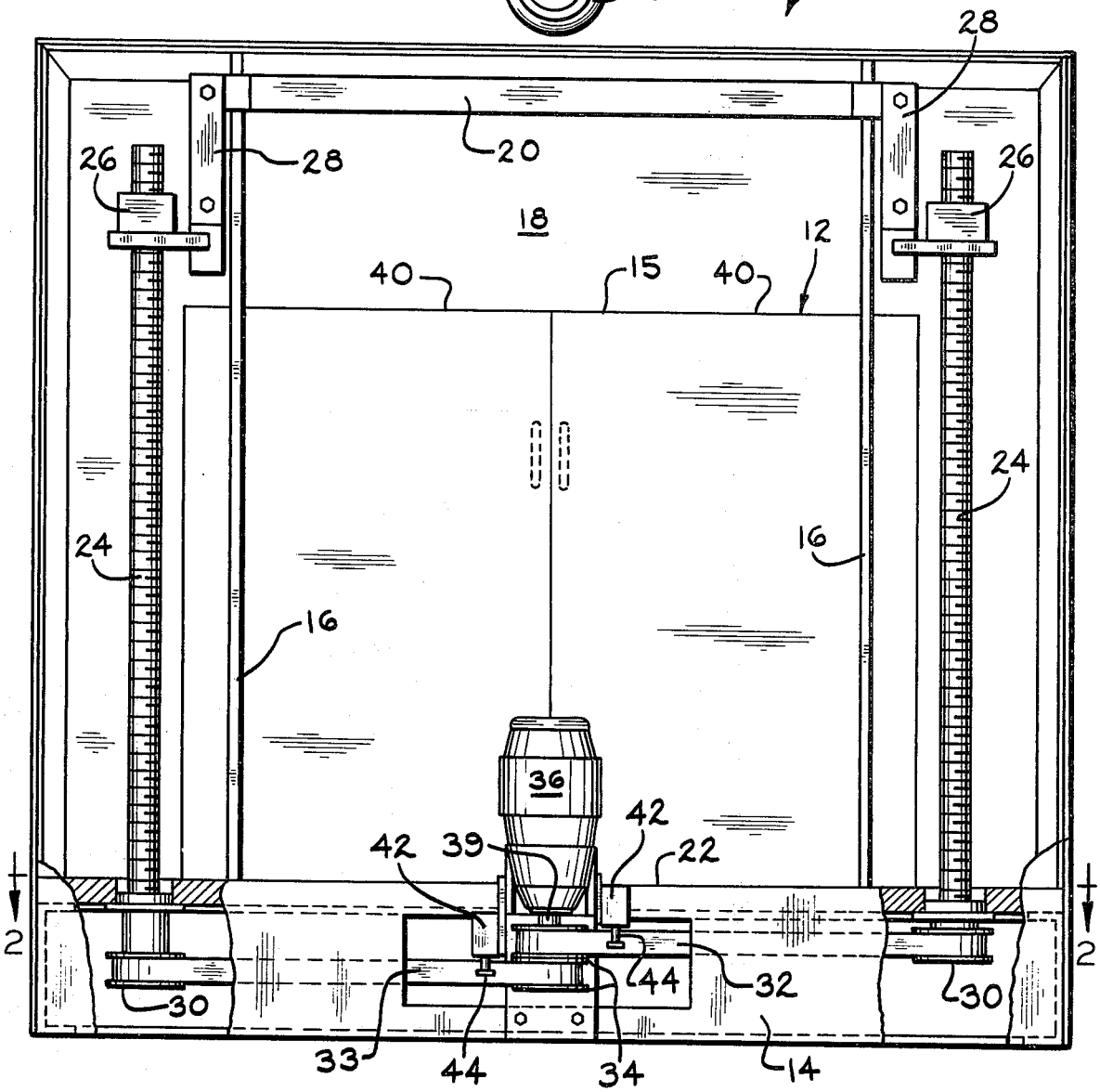

Further objects, features and advantages of this invention will become apparent from a consideration of the following description, the appended claims and the accompanying drawing in which:

FIG. 1 is a rear elevational view of the compactor apparatus of this invention, with parts of the housing broken away for purposes of clarity; and FIG. 2 is a sectional view of the apparatus, taken from substantially the line 2—2 in FIG. 1.

With reference to the drawing, the compactor apparatus of this invention, indicated generally at 10, is shown in FIG. 1 as consisting of a container 12 having a rear wall 14, a front wall 15 and side walls 16 which form a compacting chamber 18 in which paper and paper products are to be compressed. A platen 20 is mounted in the chamber 18 for up and down movement toward and away from a floor 22. A housing 21 encloses the container 12.

A pair of upright screws 24 are rotatably mounted at opposite ends of the platen 20 to supply the necessary downward pulling forces therefor. Nuts 26 are threadably mounted on the screws 24, and the platen 20 is connected to the nuts 26 by upright arms 28 which extend between the ends of platen 20 and the nuts 26. Rotation of the screws 24 causes the nuts 26 to move up or down which in turn serves to drive the platen 20 upwardly or downwardly. The screws 24 are driven by pulleys 30 secured to their lower ends.

A motor 36, mounted on plates 38 secured to the apparatus 10 and disposed rearwardly of the rear wall 14, has a downwardly extending drive shaft 39. A pair of pulleys 34 are secured to the drive shaft 39 at positions in horizontal alignment with the pulleys 30 on the screws 24. The motor 36 is located so that the pulleys 34 are equally spaced from the pulleys 30. As a result, a pair of belts 32 and 33, of substantially equal length, can be trained about the pulleys 30 and 34 so as to provide for driving of the pulleys 30 in response to operation of the motor 36. As shown in FIG. 2, the pulleys 30 and 34, and the belts 32 and 33, are relatively arranged so that the belts 32 and 33 are disposed in a substantially V-formation with the pulleys 34 at the apex of the V.

In the operation of the machine 10, material to be compacted is placed in the chamber 18 with the platen 20 in its upper position shown in FIG. 1. The motor 36 is then operated to turn the pulleys 34 thereby driving the belts 32 and 33 and the pulleys 30, to in turn rotate the screws 24 and drive the platen 20 downwardly. The material in chamber 18 is then compacted between the platen 20 and the container floor 22. The motor 36 is then operated to reversely rotate the screws 24 and return the platen 20 to its upper position for the start of another cycle. Fully compacted material is removed from the chamber 18 through a pair of doors 40.

A pair of circuit interrupting switches 42 having movable actuating arms 44 are secured to the motor mounting plates 38. The switches 42 are positioned so that the actuating arms 44 are engaged with the belts 32 and 33 as shown in FIGS. 1 and 2. The switches 42 are structured so that the arms 44 are urged toward positions opening the switches and interrupting the circuits. However, during normal operation of the apparatus 10 the belts 32 and 33 exert sufficient pressure on the arms 44 to maintain the switches 42 in closed positions. In the event that a belt 32 or 33 should break, however, the pressure on the switch arm 44 normally engaged by the belt is relieved and the arm 44 will automatically move to a position opening the switch. The switches 42 are circuit connected to the motor 36 so that in the event either switch is opened, operation of the motor 36 is discontinued. This arrangement prevents a situation in which, by virtue of belt breakage, one of the screws 24 is being rotated while the other remains idle. This situation causes tilting of the platen 20 and resultant damage to the apparatus 10 prior to shut off of the motor 36. In the apparatus 10 of this invention, whenever one of the belts 32 or 33 breaks, one of the switches 42 automatically provides for shut-off of the motor 36 to preclude damage to the apparatus.

From the above description it is seen that the present invention provides a compact baling machine 10, in which the motor 36 is located on the back of the machine 10. The motor 36 is operable to turn a pair of pulleys 34 which are connected to a pair of screw pulleys 30 by means of a pair of drive belts 32 and 33. The screw pulleys 30 rotate a pair of upright screws 24 which in turn drive a compressing platen 20. Circuit interrupting switches 42 are provided to shut off the motor 36 in response to breakage of the drive belts 32 and 33.

What is claimed is:

1. Compactor apparatus comprising a container having a a floor, front and rear walls, and a pair of side walls, a platen movable downwardly in said container toward said floor, means for moving said platen downwardly comprising a pair of upright screws located adjacent said side walls and at opposite ends of said platen, nuts threadably mounted on said screws, means securing said platen to said nuts, means for rotating said screws to thereby move said nuts and thus said platen toward and away from said floor, said means for rotating said screws comprising a motor disposed rearwardly of and adjacent said rear wall and having a drive shaft, said motor being positioned so that said drive shaft is at substantially equal distances from said upright screws, a pair of pulleys on the lower ends of said screws, a pair of pulleys mounted on said drive shaft, a pair of drive belts, each of said drive belts extending around one of said motor drive shaft pulleys and one of said screw pulleys, so that the rotation of said motor pulleys by said motor provides for rotation of said screw pulleys, thereby rotating said screws and moving said platen upwardly or downwardly, a pair of switches having actuator members, each of said actuator members being positioned in contact with one of said drive belts and electrically connected to said motor, each of said switches being operable to shut off said motor in response to breakage of the belt engaged by the actuator therefor.

* * * * *